US007401584B2

(12) United States Patent
Haefner

(10) Patent No.: US 7,401,584 B2
(45) Date of Patent: Jul. 22, 2008

(54) ADJUSTABLE ENGINE

(75) Inventor: Donald Haefner, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/631,280

(22) PCT Filed: Jun. 15, 2005

(86) PCT No.: PCT/EP2005/006385

§ 371 (c)(1),
(2), (4) Date: Apr. 25, 2007

(87) PCT Pub. No.: WO2006/002757

PCT Pub. Date: Jan. 12, 2006

(65) Prior Publication Data

US 2007/0215088 A1 Sep. 20, 2007

Related U.S. Application Data

(60) Provisional application No. 60/584,898, filed on Jul. 1, 2004.

(51) Int. Cl.
*F01L 1/14* (2006.01)

(52) U.S. Cl. ..... 123/90.48; 123/90.16; 123/90.59

(58) Field of Classification Search ..... 123/90.16, 123/90.48
See application file for complete search history.

(56) References Cited

U.S. PATENT DOCUMENTS 1,397,585 A 11/1921 James
4,607,599 A * 8/1986 Buente et al. ..... 123/90.5
4,721,074 A 1/1988 Wirth (Continued)

FOREIGN PATENT DOCUMENTS

DE 38 20 645 C2 12/1989

(Continued)

*Primary Examiner*—Zelalem Eshete
(74) *Attorney, Agent, or Firm*—Charles A. Muserlian

(57) ABSTRACT

A switchable cam follower (1) is proposed which serves to transmit a cam stroke in a variable manner from a cam to valve timing mechanism elements of an internal combustion engine. The cam follower (1) comprises substantially a cylindrical inner part (5) and a cylindrical outer part (2) which can be displaced into one another in the direction of their longitudinal axes and can be locked and unlocked in a relative position by means of coupling means (10) which are preferably actuated by pressure-modulated hydraulic medium, and also comprises at least one spring means (7) which is arranged between the inner part (5) and the outer part (2). The inner part (5) has a run-on surface (16) for the cam at one end side (17) and is radially guided in an inner wall (4) of the outer part (2) by way of an outer circumferential surface (6). The outer part (2) has an outer cylindrical circumferential surface (3), by way of which the cam follower (1) is guided in a housing hole of the internal combustion engine in a longitudinally movable manner, and an outer end face (25) facing away from the cam, as a contact face for valve timing mechanism elements which are operatively connected to the cam follower (1). Here, the outer circumferential surface (3) of the outer part (2) is to have substantially identical diameters in the region of the end face (25) which faces the valve timing mechanism element and in the region of an opening (26) which is oriented toward the inner part (5). At the same time, the spring means (7) is to be arranged within the outer part (2).

9 Claims, 1 Drawing Sheet

U.S. PATENT DOCUMENTS

| | | | |
|---|---|---|---|
| 5,934,232 | A | 8/1999 | Greene |
| 6,196,176 | B1 | 3/2001 | Groh |
| 6,382,173 | B1 | 5/2002 | Roe |
| 2003/0209215 | A1 | 11/2003 | Maisch |

FOREIGN PATENT DOCUMENTS

| | | | |
|---|---|---|---|
| DE | 695 13 165 | T2 | 11/1995 |
| DE | 44 42 057 | A1 | 5/1996 |
| DE | 199 50 989 | A1 | 6/2000 |
| DE | 199 54 388 | A1 | 6/2000 |
| EP | 1 149 989 | A1 | 10/2001 |
| EP | 1 260 681 | A2 | 5/2002 |

* cited by examiner

ADJUSTABLE ENGINE

This application is a 371 of PCT/EP2005/006385 filed on Jun. 15, 2005 which is based on provisional patent application Ser. No. 60/584,898 filed Jul. 1, 2004.

FIELD OF THE INVENTION

The invention relates to a switchable cam follower which serves to transmit a cam stroke in a variable manner from a cam to valve timing mechanism elements of an internal combustion engine and has essentially the following features:

- the cam follower comprises substantially a cylindrical inner part and a cylindrical outer part which can be displaced into one another in the direction of their longitudinal axes and can be locked and unlocked in a relative position by means of coupling means which are preferably actuated by pressure-modulated hydraulic medium, and also comprises at least one spring means which is arranged between the inner part and the outer part,
- the inner part has a run-on surface for the cam at one end side and is radially guided in an inner wall of the outer part by way of an outer circumferential surface,
- the outer part has an outer cylindrical circumferential surface, by way of which the cam follower is guided in a housing hole of the internal combustion engine in a longitudinally movable manner, and an outer end face facing away from the cam, as a contact face for valve timing mechanism elements which are operatively connected to the cam follower.

BACKGROUND OF THE INVENTION

A cam follower of this type is apparent from U.S. Pat. No. 6,382,173 which is considered to form the generic type. Here, a switchable cam follower is likewise proposed which transmits an elevation of a cam to a gas exchange valve of the internal combustion engine via housing parts which can be displaced telescopically into one another and can be coupled to one another, depending on the locking state, or is switched off for the purpose of bringing the gas exchange valve to a standstill. Here, an embodiment which is claimed in accordance with FIG. 1 of this document shows an outer part, in the guide hole of which an inner part is guided longitudinally movably with a run-on surface for the cam. Here, the resilient spacing of the outer part to the inner part is effected by a lost motion spring which is arranged on the outer circumference of the cam follower.

In this embodiment, it is a disadvantage that the ratio of the outer guide length to the outer diameter of the outer part is low, with the result that the inner part with a section facing the cam also has to contribute to the guiding of the cam follower in its housing hole in the internal combustion engine. As a consequence, however, the cam follower would have to have a double fit which is unfavorable in terms of manufacturing technology, as the outer part and the inner part have to be arranged sufficiently coaxially both respect to the housing hole and with respect to the mutual guidance.

Moreover, it is to be considered disadvantageous in this solution that there is a large-volume annular space between the outer part and the inner part, which annular space is open toward the housing hole in the internal combustion engine and during operation also feeds hydraulic medium for actuating the coupling means. A dead volume of this type is, however, unfavorable to the extent that, in the case of the usually present hydraulic medium and, in particular, in the case of a high content of gas bubbles in the hydraulic medium, the rigidity of said hydraulic medium is reduced and thus the dynamics, the reproducibility and the reliability of the switchover operation of the coupling means are impaired.

A further disadvantage results from the position of the coupling means within a cam follower of this type relative to the cam of the internal combustion engine. As the coupling means have a radial installation space requirement which is only insubstantially smaller than the outer diameter of the outer part, they are to be arranged on the other side of the lost motion spring, relative to the cam. As a consequence, the length of a sealing gap is very small between an opening in the outer part for supplying hydraulic medium to the coupling means and an opening of the housing hole which is remote from the cam, with the result that, in particular in the region of the maximum stroke of the cam follower, the risk can occur of an undesirably high pressure loss via leakage of the hydraulic medium into the surroundings of the housing hole. Moreover, there is also the risk of carrying along air or gas bubbles from the surroundings of the housing hole and enclosing them in the annular space which is filled with hydraulic medium, which has the abovementioned disadvantageous effect on the rigidity of the hydraulic medium.

OBJECT OF THE INVENTION

It is therefore an object of the invention to provide a switchable cam follower of the above-described type, in which cam follower the disadvantages mentioned are eliminated.

SUMMARY OF THE INVENTION

This object is achieved using the features of claim 1, while advantageous developments and refinements can be gathered form the subclaims. Accordingly, the outer circumferential surface of the outer part has substantially identical diameters in the region of the end face which faces the valve timing mechanism element and in the region of an opening which is oriented toward the inner part. At the same time, the spring means is arranged within the outer part.

As a result, a switchable cam follower is provided which can be manufactured without double fits and thus simply, reliably in process terms and inexpensively. It is sufficient to guide the cam follower exclusively with the outer part in the housing hole in the internal combustion engine, with the result that the risk of it jamming in the housing hole and of the inner part jamming relative to the outer part is minimized.

Furthermore, by arranging one or more lost motion springs as spring means within the outer part, a switchover process is ensured for the coupling means which are preferably acted on by modulated hydraulic medium pressure, with high dynamics, reproducibility and reliability in the entire operating range of the internal combustion engine which is relevant to the switchover. This advantage is based on the fact that the movement space which is occupied by the cam follower does not contain any substantial hydraulic dead volumes which, in the event of gas bubbles being included, would reduce the rigidity of the hydraulic medium and consequently impair the quality of the switchover process considerably.

Furthermore, the inner arrangement of the lost motion springs makes it possible to position the coupling means at as small a distance from the cam as possible, as the coupling means are then preferably situated completely between the cam-side end side of the inner part and the lost motion springs. To this extent, increased degrees of freedom are offered to the constructor of the internal combustion engine with regard to the position and dimensioning of a rail which guides the hydraulic medium and with regard to the length of the housing hole which guides the cam follower, as the sealing lengths between the cam follower and the housing hole which influence the pressure loss as a consequence of leakage of the hydraulic medium can be designed to be sufficiently large in every stroke state of the cam follower.

In one development of the invention, the use of one or more cylindrical lost motion springs is provided, which springs are arranged concentrically with respect to the longitudinal axis of the cam follower. A lost motion spring assembly which is nested makes it possible, in particular, to utilize the installation space between the outer part and the inner part in an optimum manner with regard to a maximum spring work capability, and to minimize the length and mass of the cam follower as a consequence. Here, the use of helical compression springs is to be particularly preferred from a cost/benefit viewpoint.

In a further particularly preferred refinement of the invention, there is provision for the inner part to have a hollow cylindrical recess on the side which is remote from the cam. In addition to good radial guiding of the lost motion springs which extend into this recess, this is to be seen as a further means for reducing the weight of the cam follower. At the same time, the wall which surrounds the recess ensures a favorable guiding length, and support of the transverse forces, of the inner part in the outer part. Moreover, a pressure loss of the hydraulic medium as a consequence of leakage through the guide gap between the inner part and the outer part is minimized.

In a further advantageous refinement, the coupling means comprise at least one piston which is mounted with a cylindrical section in a coupling means hole of the inner part so as to be displaceable counter to the force of a spring means. Said piston has a partially cylindrical section with a longitudinal surface at an opening of the coupling means hole which is oriented toward the outer part. In the locked state of the cam follower, the partially cylindrical section reaches into an annular groove which is situated in the inner wall of the outer part. Here, the longitudinal surface of the piston is oriented constantly toward an axial shoulder of the annular groove so as to point in a direction away from the cam, for the unimpeded entry into the annular groove and for the low-wear force transmission of the movement from the inner part to the outer part. This can be brought about by suitable antirotation safeguard elements such as a circlip which is situated in the inner part.

In one development of the invention, it is proposed that the outer end face of the outer part is planar and perpendicular with respect to the longitudinal axis of the cam follower. This is advantageous when the cam follower is not in direct contact with a tappet push rod, but rather actuates a valve timing mechanism element directly, such as a rocker arm whose pivot point is fixed in itself. The latter then makes sliding and/or rolling contact with the end face of the outer part which is planar or optionally shaped to be slightly spherical or cylindrical.

An outer part which is configured in this way is manufactured particularly advantageously in a sheet metal molding process, in particular as a product of a deep-drawing process.

One embodiment of the cam follower which aims at minimum valve timing mechanism friction provides a roller as the run-on surface for the cam in the inner part, which roller is mounted on a sliding bearing or, in particular, on a roller bearing. It goes without saying that a pin which mounts the roller rotatably is to be secured against moving axially out of the inner part by suitable means, such as calking and/or securing rings.

Further elements are expressly included in the scope of protection of this invention, as long as they are required for the functioning of the switchable cam follower or are beneficial for said functioning. They include, in particular, stop means for the inner travel limitation of the piston means in the inner part, drainage openings on that side of the piston means which faces away from the actuating hydraulic medium, and drainage openings from the space for the lost motion springs which is formed from the inner part and the outer part. Furthermore, suitable stop means should be mentioned for the axial limitation of the relative movement of the inner part with respect to the outer part, and for the setting of a defined amount of idle travel between the piston means and the annular groove in the stroke direction of the cam follower. Finally, the scope of protection also relates to those elements which, if required, bring about an antirotation safeguard between the inner part and the outer part and also between the outer part and the housing hole of the cam follower. Exemplary embodiments of the abovementioned elements have, however, already been proposed in numerous documents and are also sufficiently known to experts from applications, with the result that a further description is dispensed with in this document.

BRIEF DESCRIPTION OF THE DRAWINGS

The invention is described in greater detail using the appended drawing in which one exemplary embodiment is shown. In the drawing.

DETAILED DESCRIPTION OF THE DRAWINGS

Figure 2:
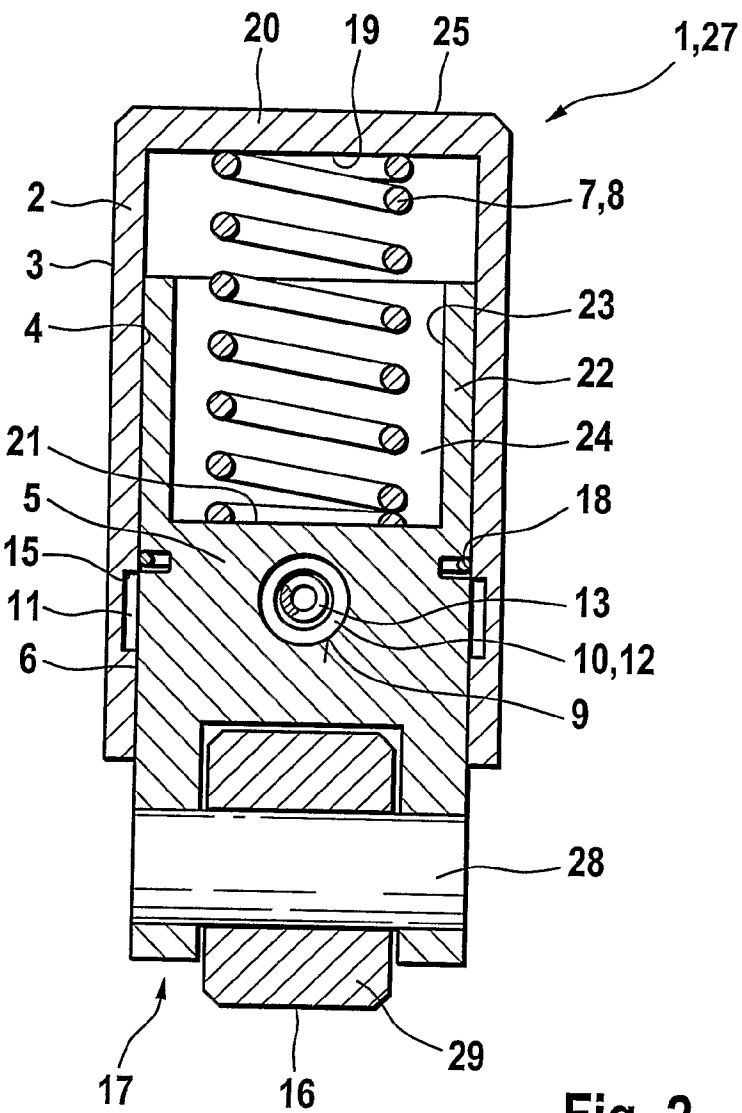
FIG. 2 shows a longitudinal section according to FIG. 1 which has been rotated by 90°.
Figure 1:
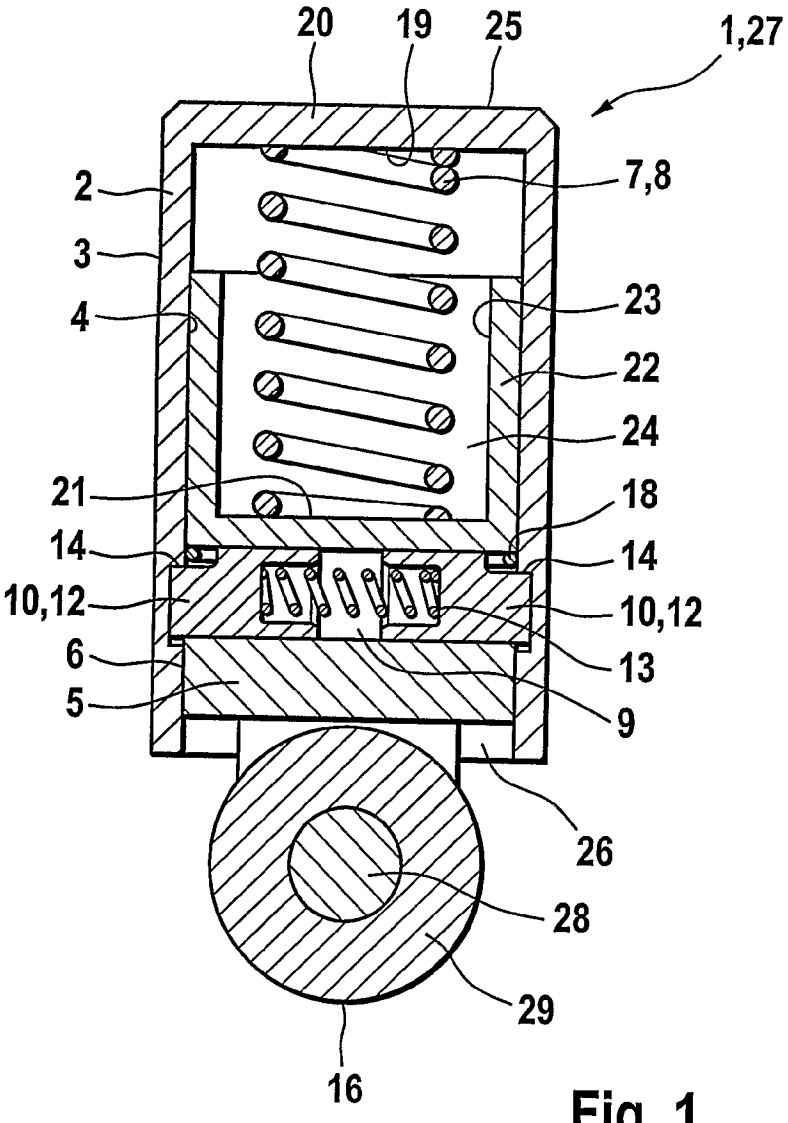
FIG. 1 shows a longitudinal section through a switchable cam follower which is configured as a roller tappet.

FIGS. 1 and 2 show a switchable cam follower 1 for actuating a valve timing mechanism of an internal combustion engine in a variable stroke manner. The cam follower 1 comprises a cylindrical outer part 2 with an outer circumferential surface 3 which is guided longitudinally movably in a housing hole in the internal combustion engine, and an inner wall 4 in which an inner part 5 is guided longitudinally movably with an outer circumferential surface 6.

A spring means 7 is embodied as a lost motion spring 8 which is configured as a helical compression spring, and is arranged concentrically with respect to the cam follower 1. Said lost motion spring 8 spaces apart the outer part 2 from the inner part 5 in conjunction with suitable stop means (not shown), in such a way that coupling means 10 which are situated in a coupling means hole 9 of the inner part 5 lie opposite an annular groove 11 which is situated in the inner wall 4 of the outer part 2. The coupling means 10 which are configured here as pistons 12 can be actuated in a longitudinally movable manner in the coupling means hole 9 of the inner part 5, counter to the force of a spring means 13. The pistons 12 have longitudinal surfaces 14 which are oriented substantially parallel to an axial shoulder 15 of the annular groove 11. Here, the longitudinal surfaces 14 at the same time face way from a run-on surface 16 which is in engagement on one end side 17 of the inner part 5 with a cam of the internal combustion engine, and are fixed in this orientation by means of an antirotation safeguard element 18 which is arranged parallel to the longitudinal surfaces 14 and is configured as a circlip.

The lost motion spring 8 is situated within the outer part 2 and is supported between an inner rest 19 of a base 20 of the outer part 2 and an opposite rest 21 of the inner part 5. Here, a hollow cylindrical section 22 with an inner wall 23 extends, starting from the rest 21, in the direction of the base 20, which inner wall 23 delimits a recess 24 at its circumference and centers the lost motion spring 8 which is partially situated in the recess 24.

As an alternative to the one helical compression spring shown, it is possible to use one or more compression springs, even of a different construction. Here, there is the possibility of nesting them concentrically or distributing them next to one another on a circumference and centering them in a corresponding number of recesses 24.

An outer end face 25 of the outer part 2 is configured to be planar and perpendicular with respect to the circumferential surface 3, and is therefore suitable to be in direct contact with a rocker arm whose pivot point is fixed in itself, as a further valve timing mechanism element which transmits the movement of the cam follower 1. As an alternative to this, however, the end face 25 can be spherical or cylindrical or else have a concave recess for accommodating a tappet push rod.

The circumferential surface 3 of the outer part 2 has substantially identical diameters in the region of the end face 25 and in the region of an opening 26 which is oriented toward the inner part 5. As, furthermore, the person skilled in the art infers from the figures, the outer part 2 is additionally also predestined on account of its wall thicknesses to be manufactured in a sheet metal molding process and preferably as a deep-drawn part.

In the cam follower 1 which is configured here as a roller tappet 27, the run-on surface 16 for the cam which is situated on the inner part 5 is configured as a roller 29 which is mounted rotatably on a pin 28. The roller 29 is mounted on a roller bearing on the pin 28 in the figures; however, it is also feasible to mount it by means of rolling bodies.

LIST OF REFERENCE NUMERALS

1 Cam follower
2 Outer part
3 Circumferential surface
4 Inner wall
5 Inner part
6 Circumferential surface
7 Spring means
8 Lost motion spring
9 Coupling means hole
10 Coupling means
11 Annular groove
12 Piston
13 Spring means
14 Longitudinal surface
15 Shoulder
16 Run-on surface
17 End side
18 Antirotation safeguard element
19 Inner rest
20 Base
21 Rest
22 Section
23 Inner wall
24 Recess
25 End face
26 Opening
27 Roller tappet
28 Pin
29 Roller

The invention claimed is:

1. A switchable cam follower which serves to transmit a cam stroke in a variable manner from a cam to valve timing mechanism elements of an internal combustion engine and has essentially the following features:

the cam follower comprises substantially a cylindrical inner part and a cylindrical outer part which can be displaced into one another in the direction of their longitudinal axes and can be locked and unlocked in a relative position by means of coupling means which are actuated by pressure-modulated hydraulic medium, and also comprises at least one spring means which is arranged between the inner part and the outer part, the inner part has a run-on surface for the cam at one end side and is radially guided in an inner wall of the outer part by way of an outer circumferential surface, the outer part has an outer cylindrical circumferential surface, by way of which the cam follower is guided in a housing hole of the internal combustion engine in a longitudinal movable manner, and an outer end face facing away from the cam, as a contact face for valve timing mechanism elements which are operatively connected to the cam follower, wherein the outer circumferential surface of the outer part has substantially identical diameters in the region of the end face which faces the valve timing mechanism element and in the region of an opening which is oriented toward the inner part, and wherein the spring means is arranged within the outer part, wherein the coupler means comprise at least one piston which is mounted with a cylindrical section in a coupling means hole of the inner part so as to be displaceable counter to the force of a spring means and which has a partially cylindrical section with a longitudinal surface at an opening of the coupling means hole which is oriented toward the outer part, there is an annular groove in the inner wall of the outer part, into which annular groove the piston reaches with the partially cylindrical section in the locked state of the cam follower, the longitudinal surface of the partially cylindrical section being oriented constantly substantially parallel to an axial shoulder of the annular groove and facing away from the run-on surface for the cam, by means of an antirotation safeguard element located in the inner part, and being in force-transmitting contact with this axial shoulder in the event of the intended transmission of movement between the inner part and the outer part of the cam follower.

2. The cam follower of claim 1, wherein, as seen in a side view of the cam follower, the coupler means are arranged in a plane which is at least approximately perpendicular with respect to the longitudinal axis of the cam follower, and completely between that end side of the inner part which is on the cam side and a rest for the spring means.

3. The cam follower of claim 1, wherein the spring means has a cylindrical shape and is arranged substantially concentrically with respect to the longitudinal axis of the cam follower.

4. The cam follower of claim 3, wherein the spring means comprises at least one helical compression spring.

5. The cam follower of claim 3, wherein the inner part has, on a side which is remote from the cam, at least one hollow cylindrical recess into which the spring means extends at least partially, an inner wall of said recess surrounding an outer circumference of the spring means in a centering manner.

6. The cam follower of claim 1, wherein that end face of the outer part which faces the valve timing mechanism element is configured to be substantially planar and perpendicular with respect to the outer circumferential surface of the outer part.

7. The cam follower of claim 6, wherein a valve timing mechanism element which is operatively connected at least indirectly to the end face of the outer part transmits the movement of the cam follower in the manner of a lever to further valve timing mechanism elements and is a rocker arm.

8. The cam follower of claim 1, wherein the outer part is manufactured in a sheet metal molding process.

9. The cain follower of claim 1, wherein the run-on surface of the inner part for the cam is configured as a roller which is rotatable about a pin and is optionally mounted by means of rolling bodies, the pin being mounted axially and radially in the inner part.

* * * * *